US007026752B2

(12) United States Patent
Kyono et al.

(10) Patent No.: US 7,026,752 B2
(45) Date of Patent: Apr. 11, 2006

(54) GLASS FUNNEL AND GLASS BULB FOR CATHODE RAY TUBE

(75) Inventors: Masaya Kyono, Otsu (JP); Hiroshi Kakigi, Otsu (JP)

(73) Assignee: Nippon Electric Glass Co., Ltd., Shiga-Ken (JP)

( * ) Notice: Subject to any disclaimer, the term of this patent is extended or adjusted under 35 U.S.C. 154(b) by 191 days.

(21) Appl. No.: 10/399,760

(22) PCT Filed: Dec. 7, 2001

(86) PCT No.: PCT/JP01/10757

§ 371 (c)(1),
(2), (4) Date: Sep. 22, 2003

(87) PCT Pub. No.: WO02/47106

PCT Pub. Date: Jun. 13, 2002

(65) Prior Publication Data

US 2004/0090559 A1 May 13, 2004

(30) Foreign Application Priority Data

Dec. 7, 2000 (JP) ..... 2000-373313
Dec. 7, 2000 (JP) ..... 2000-373314

(51) Int. Cl.
*H01J 29/86* (2006.01)
*H01J 5/20* (2006.01)

(52) U.S. Cl. ..... 313/477 R; 313/461; 220/2.1 A; 220/2.3 A

(58) Field of Classification Search ..... 313/477 R, 313/461; 220/2.1 A, 2.3 A, 2.3 R; 348/823
See application file for complete search history.

(56) References Cited

U.S. PATENT DOCUMENTS

| | | | | |
|---|---|---|---|---|
| 4,030,627 | A * | 6/1977 | Lentz | 220/2.1 A |
| 4,483,452 | A | 11/1984 | Blanding et al. | 220/2.1 |
| 4,686,415 | A * | 8/1987 | Strauss | 313/402 |
| 6,680,567 | B1 * | 1/2004 | Sugawara et al. | 313/477 R |
| 2003/0025439 | A1 | 2/2003 | Fujita | 313/477 |

FOREIGN PATENT DOCUMENTS

| | | |
|---|---|---|
| JP | 49-123262 | 11/1974 |
| JP | 59-189541 | 10/1984 |
| JP | 63-102144 | 5/1988 |
| JP | 63-250046 | 10/1988 |
| JP | 3-103548 | 10/1991 |
| JP | 03-236142 | 10/1991 |
| JP | 07-320661 | 12/1995 |

* cited by examiner

*Primary Examiner*—Karabi Guharay
(74) *Attorney, Agent, or Firm*—J.C. Patents

(57) ABSTRACT

A body portion of the funnel has a first region of dimension h, the dimension h being measured from the seal edge surface in a direction parallel to a tube axis, and a second region excluding the first region. The second region has a thickness relatively smaller than the thickness of the first region, so that a boundary portion between the two regions forms a stepped portion on the external surface of the body portion.

12 Claims, 10 Drawing Sheets

(minor-axis section)

(minor-axis section)

(diagonal-axis section)

GLASS FUNNEL AND GLASS BULB FOR CATHODE RAY TUBE

BACKGROUND OF THE INVENTION

The invention relates to a glass funnel and a glass bulb for a cathode-ray tube for use in television reception or the like.

As shown in FIG. 9, for example, a glass bulb 11 for constituting a cathode-ray tube for use in television reception or the like comprises a glass panel (hereinafter, referred to as "panel") 12 on which images are displayed, a glass funnel (hereinafter, referred to as "funnel") 13 having the shape of a funnel which forms the back thereof, and a neck portion 14 in which an electron gun is installed. The neck portion 14 is fusion bonded to a smaller opening portion of the funnel 13. The panel 12 has a face portion 12*a* which makes an image viewing area and a skirt portion 12*b* which extends generally perpendicularly from the periphery of the face portion 12*a*. As shown enlarged in FIG. 10, a seal edge surface 12*b*1 arranged on the end surface of the skirt portion 12*b* and a seal edge surface 13*c*1 arranged on a larger opening portion of the funnel 13 are joined to each other through a seal glass 15 for sealing.

The glass bulb 11 for a cathode-ray tube, formed as described above, is used as a vacuum vessel after installing an electron gun in the neck portion 14 and then evacuating inside thereof (the internal pressure after the evacuation is on the order of, e.g., $10^{-8}$ Torr). Consequently, the external surface of the glass bulb 11 undergoes a stress caused by the load of the atmospheric pressure (hereinafter, this stress will be referred to as "vacuum stress"). It is required that the glass bulb 11 has mechanical and structural strengths sufficient to resist a fracture resulting from this vacuum stress (vacuum fracture). That is, if these strengths are insufficient, the glass bulb 11 may cause fatigue fracture since it cannot endure the vacuum stress. In addition, if accompanied with such foreign factors as minute flaws on the external surface or the application of an impact load, the fatigue fracture is expected to proceed faster. Besides, in the step of fabricating the cathode-ray tube, the glass bulb 11 is raised to around 400° C. in temperature. The thermal stress resulting from the temperature rise and the vacuum stress may produce a synergistic effect toward fracture.

Since the glass bulb 11 is aspheric, the vacuum stress acts on the glass bulb 11 as compressive stress and tensile stress. These stresses have general distributions as shown in FIG. 11. Here, FIGS. 11(*a*), (*b*), and (*c*) show stress distributions in a minor-axis section, a major-axis section, and a diagonal-axis section, respectively. In these stress distribution diagrams, the regions indicated with inward arrows represent regions undergoing compressive stress, and the regions indicated with outward arrows regions undergoing tensile stress.

Glass structures are generally weaker to tensile stress than to compressive stress in fracture strength. In the glass bulb 11 for a cathode-ray tube, as a vacuum vessel, a fracture is easy to progress originating with the regions undergoing tensile stress that results from the vacuum stress (hereinafter, this stress will be referred to as "tensile vacuum stress"), namely, the region extending from the periphery of the face portion 12*a* to the skirt portion 12*b* of the panel 12 and the region around the seal edge surface 13*c*1 of the funnel 13. In particular, the seal edge surface 12*b*1 of the panel 12 and the seal edge surface 13*c*1 of the funnel 13 are joined through the seal glass 15 for sealing. Since this joint portion is a weak point in strength while the tensile vacuum stress peaks in the vicinity of the joint portion {FIGS. 11(*a*) and (*b*)}, preventive measures against the fracture originating with the joint portion are of importance. For such reasons, the conventional glass bulb 11 for a cathode-ray tube has been increased in thickness to secure necessary fracture strength.

Recently, flatter or larger screens are required to displays for television reception and the like. Based on this, cathode-ray tubes are also on the way to flattening or planarization. Accordingly, glass bulbs for a cathode-ray tube are getting farther from being spherical in shape than ever before, and the vacuum stress distribution is increasing in the degree of unevenness. Thus, the strength level required to the glass bulbs for a cathode-ray tube grows in severity. This results in a further increase in the thickness of the glass bulbs for a cathode-ray tube, accompanied with an increase in weight. The increase in the weight of the glass bulbs for a cathode-ray tube not only imposes an inconvenience on transportation, handling, and the like, but also causes an increase in the weight of the final products incorporating the cathode-ray tubes, thereby causing lower commercial values. In particular, large-sized glass bulbs for a cathode-ray tube are more prone to that tendency.

Under the foregoing circumstances, a weight reduction is desired of glass bulbs for a cathode-ray tube. Meanwhile, it is also important to secure strength sufficient to resist vacuum fracture since the flattening or planarization of the cathode-ray tubes has increased the degree of unevenness of the vacuum stress acting on the glass bulbs for a cathode-ray tube.

SUMMARY OF THE INVENTION

It is an object of the present invention to provide a glass funnel for a cathode-ray tube which is light in weight and capable of securing strength sufficient to resist vacuum fracture when constituting a cathode-ray tube.

Another object of the present invention is to provide, in a glass bulb for a cathode-ray tube having a glass panel for a cathode-ray tube which is substantially flat at an external surface of a face portion thereof, a constitution which can achieve a reduction in weight and secure strength sufficient to resist vacuum fracture.

To achieve the objects, the present invention provides a glass funnel for a cathode-ray tube, having a shape of a funnel with a larger opening portion at one end and a smaller opening portion at the other end, comprising a seal edge portion extending from a seal edge surface of the larger opening portion to a mold match line, a yoke portion to be equipped with a deflection yoke, the yoke portion being arranged at a side of the smaller opening portion, and a body portion for continuing between the mold match line and the yoke portion. In the constitution, the seal edge surface has a thickness almost equal to a thickness of a seal edge surface of a glass panel for a cathode-ray tube to be joined thereto. The body portion has a region of dimension h measured from the seal edge surface in a direction parallel to a tube axis and the other region excluding the region of dimension h. When constituting a cathode-ray tube, the region of dimension h falls on a region to undergo tensile vacuum stress resulting from a vacuum pressure in the cathode-ray tube. The other region has a thickness smaller than the thickness of the region of dimension h, so that a boundary portion between the region of dimension h and the other region forms a stepped portion on an external surface of the body portion. The stepped portion has a step $\Delta T$ of $0.06 \leqq \Delta T/S \leqq 0.3$ with respect to a thickness S of the seal edge surface.

Here, the "mold match line" refers to a mold matching plane between a bottom mold (a mold having a molding surface of funnel shape for molding the portions except the seal edge portion) and a shell mold (a mold of generally rectangular annular shape to be placed in position on and combined with the bottom mold to mold the seal edge portion precisely) which constitute a female mold out of the molds used in press-molding the glass funnel for a cathode-ray tube. A gob of molten glass (glass gob) is supplied into the female mold constituted by the bottom mold and the shell mold, then a plunger as a male mold is pressed into the female mold to extend the glass gob along the molding surface of the female and male molds under pressure. Thus, the glass funnel for a cathode-ray tube is molded.

According to the glass funnel for a cathode-ray tube as mentioned above, since the seal edge surface thereof has the thickness S almost equal to the thickness of the seal edge surface of the glass panel for a cathode-ray tube, a joint area between the two seal edge surfaces is sufficiently secured so that the joint with the seal glass for sealing or the like can be easily firmly performed. Consequently, the joint portion of the panel and the funnel can secure sufficient strength.

ded into the region of dimension h, the dimension h being measured from the seal edge surface in the direction parallel to the tube axis, and the other region excluding the region of dimension h. The two regions are given different thicknesses from each other. That is, the thickness of the other region is rendered relatively smaller than the thickness of the region of dimension h.

As stated before, the tensile vacuum stress in the conventional glass bulb for a cathode-ray tube peaks in the vicinity of the joint portion between the panel and the funnel on the major sides and the minor sides {FIGS. 11(*a*) and (*b*)}. In contrast, according to the glass funnel for a cathode-ray tube of the present invention, the body portion is given the foregoing constitution so that the region of dimension h, relatively greater in thickness, is arranged at the side of the seal edge portion and the other region, relatively smaller in thickness, is arranged at the side of the smaller opening portion. Consequently, when constituting the cathode-ray tube, the peaks of the tensile vacuum stress on the major sides and the minor sides shift toward the side of the smaller opening portion (toward the side of the neck portion) from the vicinity of the joint portion between the panel and the funnel (see FIG. 7 to be described later). As a result, the tensile vacuum stress acting on the joint portion, which is a weak point in strength, is relieved and the strength against vacuum fracture is further improved. In addition, the provision of the other region having a relatively smaller thickness allows a weight reduction of the glass funnel for a cathode-ray tube.

Since the region of dimension h and the other region are given different thicknesses for the reason mentioned above, the boundary portion between the two regions forms the stepped portion on the external surface of the body portion. If this stepped portion has too small a step $\Delta T$, the reduction in the thickness of the other region becomes insufficient, thereby failing to achieve a weight reduction of the glass funnel for a cathode-ray tube and the effect of relieving the tensile vacuum stress acting on the joint portion sufficiently. On the contrary, if the step $\Delta T$ is excessively great, the other region becomes too small in thickness, thereby lacking strength against vacuum stress. With the viewpoint of achieving a weight reduction of the glass funnel for a cathode-ray tube and the effect of relieving the tensile vacuum stress acting on the joint portion sufficiently, and securing a desired strength, the step $\Delta T$ is set to fall within the range of $0.06 \leqq \Delta T/S \leqq 0.3$, and preferably $0.06 \leqq \Delta T/S \leqq 0.2$, with respect to the thickness S of the seal edge surface.

In the foregoing constitution, with the viewpoint of achieving a weight reduction of the glass funnel for a cathode-ray tube and the effect of relieving the tensile vacuum stress acting on the joint portion sufficiently, the dimension h is preferably set to fall within the range of $0.5 \leqq h/S \leqq 1.5$ with respect to the thickness S of the seal edge surface.

In the foregoing constitution, the other region preferably has a thickness T of $0.5 \leqq T/T_R \leqq 1$ with respect to a thickness $T_R$ at a boundary with the stepped portion. Here, the "thickness T" refers to the thickness of the other region at an arbitrary position except the boundary (thickness $T_R$) with the stepped portion.

Moreover, in the foregoing constitution, it is preferable that an external surface of the region of dimension h forms an inclined surface spreading out toward the mold match line, and an angle A formed between the external surface and a plane perpendicular to the mold match line is set within the range of $3° \leqq A \leqq 15°$. This can enhance the releasability from the molds, thereby preventing the external surface of the region of dimension h from scratches with the molds and making the effect of the provision of the region of dimension h practically effective. Alternatively, the external surface of the region of dimension h may form a curved surface spreading out toward the mold match line, and an angle B formed between a tangent plane of the external surface across the mold match line and a plane parallel to the tube axis be set within the range of $3° \leqq B \leqq 15°$. This provides the same effects as the foregoing.

To achieve the foregoing objects, the present invention also provides a glass bulb for a cathode-ray tube comprising: a glass panel for a cathode-ray tube including a face portion having a substantially flat external surface, a skirt portion extending from the periphery of the face portion, and a seal edge surface arranged on an end surface of the skirt portion; the glass funnel for a cathode-ray tube having the constitution described above; and a neck portion in which an electron gun is installed, the neck portion being joined to the smaller opening portion of the glass funnel for a cathode-ray tube. The seal edge surface of the glass panel for a cathode-ray tube and the seal edge surface of the glass funnel for a cathode-ray tube are joined to each other.

Here, "substantially flat" means that the external surface of the face portion has a generatrix of 10000 mm or greater in the radius of curvature along the diagonal axis.

As stated previously, glass bulbs for a cathode-ray tube having a glass panel for a cathode-ray tube in which an external surface of a face portion is substantially flat tend to have greater weights in relation to strength. According to the glass bulb for a cathode-ray tube of the present invention, the contradictory characteristics of strength and light weight can be provided in favorable balance because of the effect related to the glass funnel for a cathode-ray tube described above.

According to the present invention, it is possible to provide a glass funnel for a cathode-ray tube which is light in weight and capable of securing strength sufficient to resist vacuum fracture when constituting a cathode-ray tube.

According to the present invention, it is also possible to achieve a reduction in weight and secure strength sufficient to resist vacuum fracture in a glass bulb for a cathode-ray tube having a glass panel for a cathode-ray tube in which an external surface of a face portion is substantially flat.

DETAILED DESCRIPTION OF THE PREFERRED EMBODIMENTS

Hereinafter, embodiments of the present invention will be described with reference to the drawings.

Figure 1:
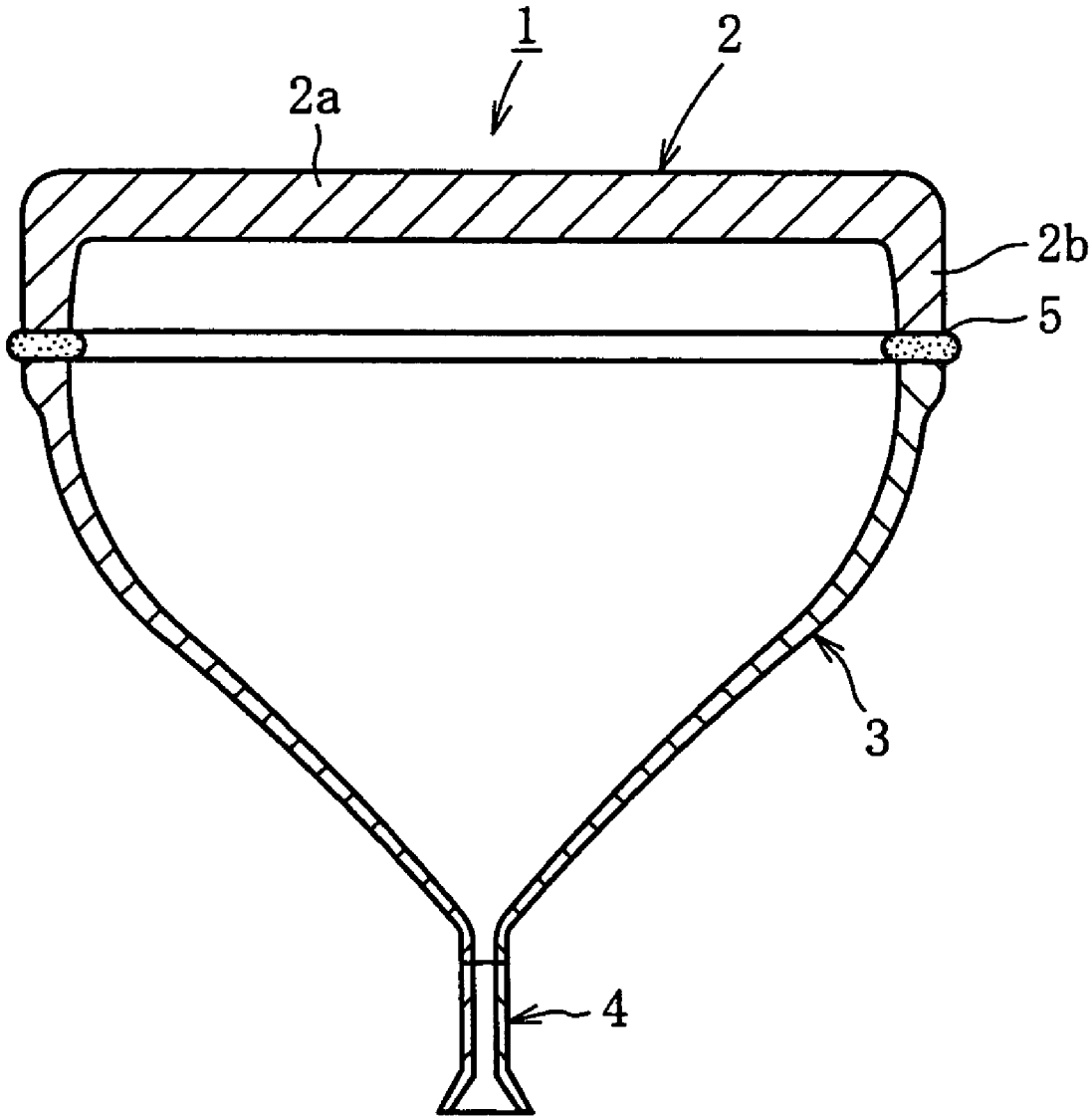
FIG. 1 is a sectional view of a glass bulb according to an embodiment, taken along a direction parallel to the tube axis.

FIG. 1 shows a glass bulb 1 for a cathode-ray tube according to the embodiment. The glass bulb 1 constitutes a cathode-ray tube for use in television reception or the like, and comprises a glass panel (hereinafter, referred to as "panel") 2 on which images are displayed, a glass funnel (hereinafter, referred to as "funnel") 3 having the shape of a funnel which forms the back thereof, and a neck portion 4 in which an electron gun is installed.

Figure 2:
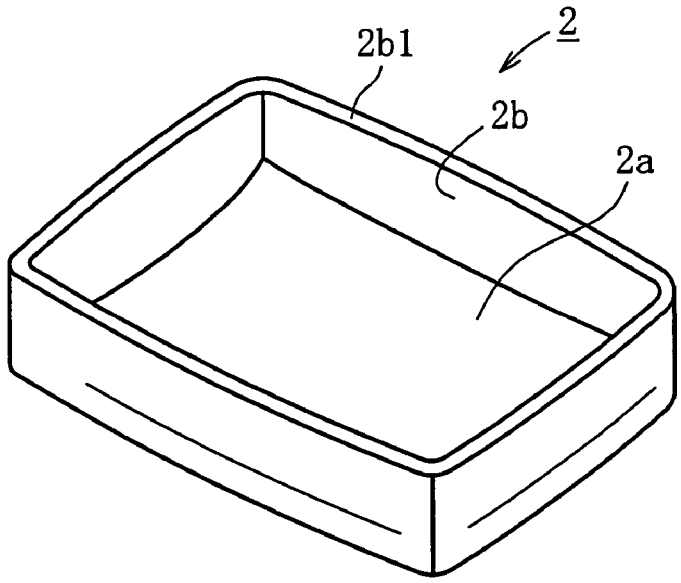
FIG. 2 is a perspective view of a panel according to the embodiment.

The panel 2 has a face portion 2*a* which makes an image viewing area and a skirt portion 2*b* which extends generally perpendicularly from the periphery of the face portion 2*a*. As shown in FIG. 2, a seal edge surface 2*b*1 is arranged on the end surface of the skirt portion 2*b*. The external surface of the face portion 2*a* has a generatrix of 10000 mm or greater in the radius of curvature along the diagonal axis, forming a substantially flat surface.

Figure 3:
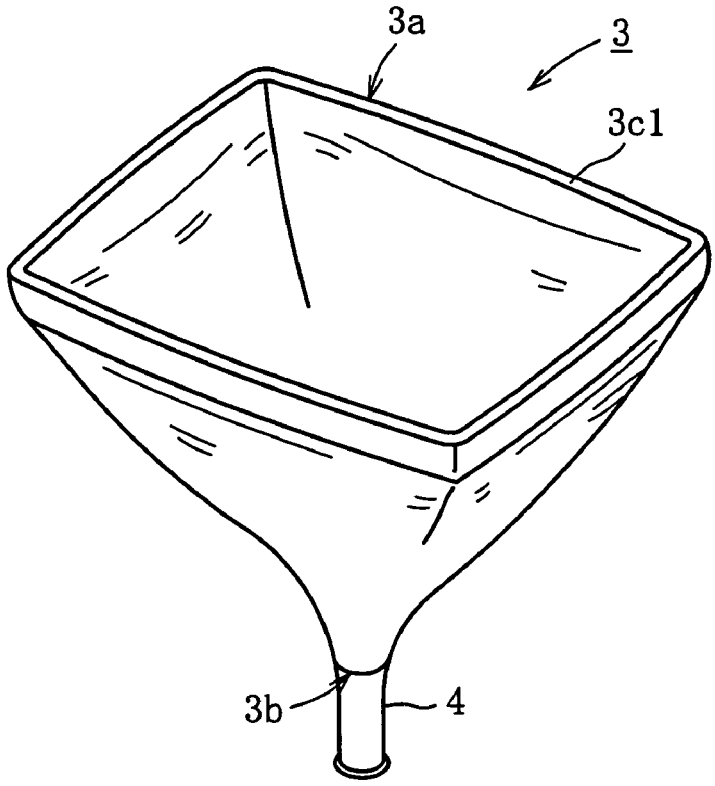
FIG. 3 is a perspective view of a funnel according to the embodiment.
Figure 4:
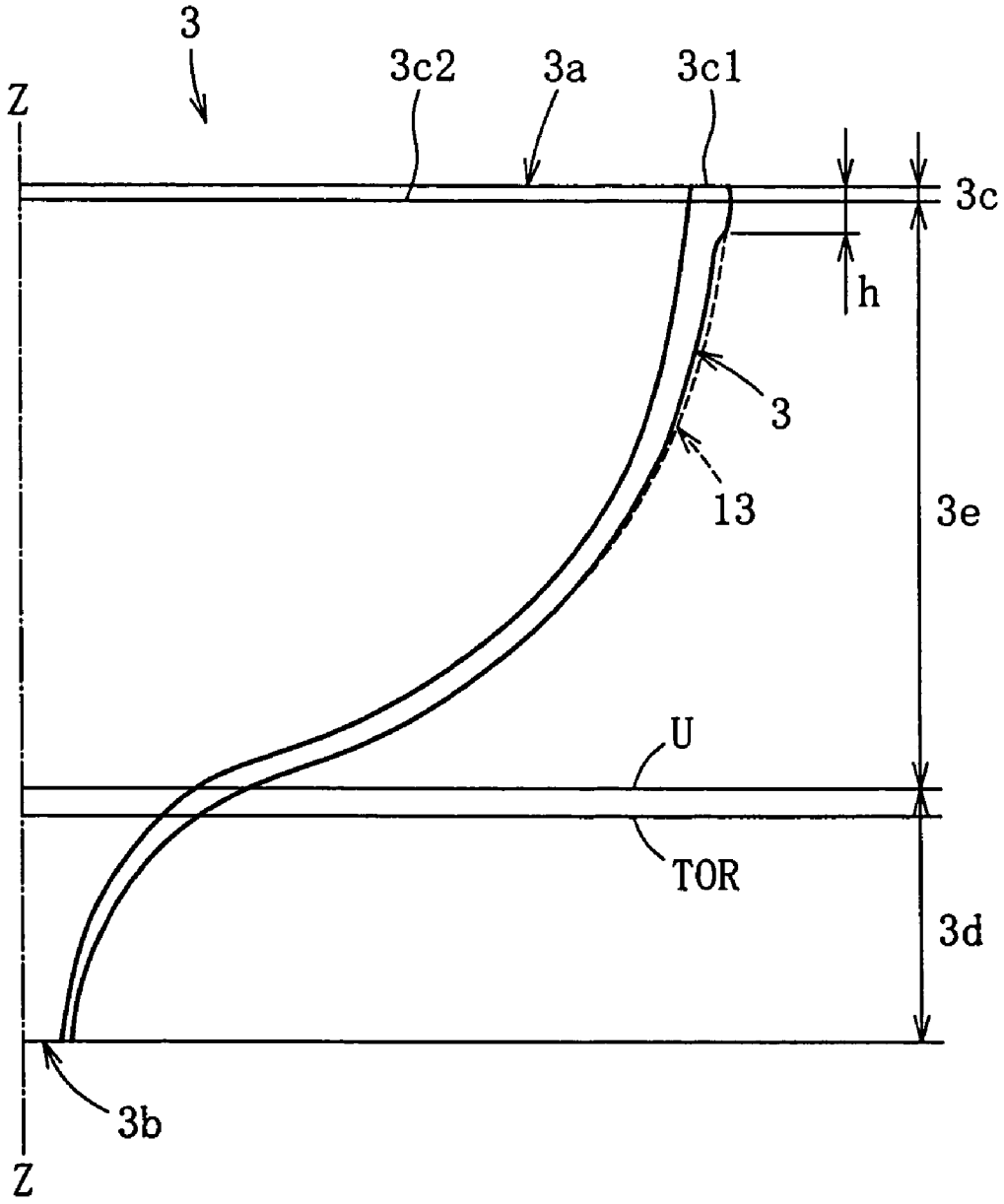
FIG. 4 is a partial sectional view of the funnel, taken along a direction parallel to the tube axis.

As shown in FIGS. 3 and 4, the funnel 3 has the shape of a funnel with a larger opening portion 3*a* at one end and a smaller opening portion 3*b* at the other end. The funnel 3 comprises a seal edge portion 3*c* which extends from a seal edge surface 3*c*1 of the larger opening portion 3*a* to a mold match line 3*c*2, a yoke portion 3*d* which is arranged at the side of the smaller opening portion 3*b* and to be equipped with a deflection yoke, and a body portion 3*e* continuing between the mold match line 3*c*2 and the yoke portion 3*d*. The neck portion 4 is fusion bonded to the smaller opening portion 3*b* of the funnel 3. Here, the body portion 3*e* and the yoke portion 3*d* are continuous to each other across an interface U which is perpendicular to a tube axis Z and passes through a position to be the inflection point of the shape of the external surface. The interface U typically lies slightly closer to the larger opening portion 3*a* than TOR (Top Of Round: a starting position from which a circular sectional shape on the side of the smaller opening portion 3*b* gradually changes into a rectangular sectional shape on the side of the larger opening portion 3*a*).

As shown in FIG. 1, the panel 2 and the funnel 3 fusion bonded with the neck portion 4 are fusion bonded to each other at their respective seal edge surfaces 2*b*1 and 3*c*1 through a seal glass 5 for sealing. The glass bulb 1 is thereby constituted as a vacuum vessel.

Figure 5:
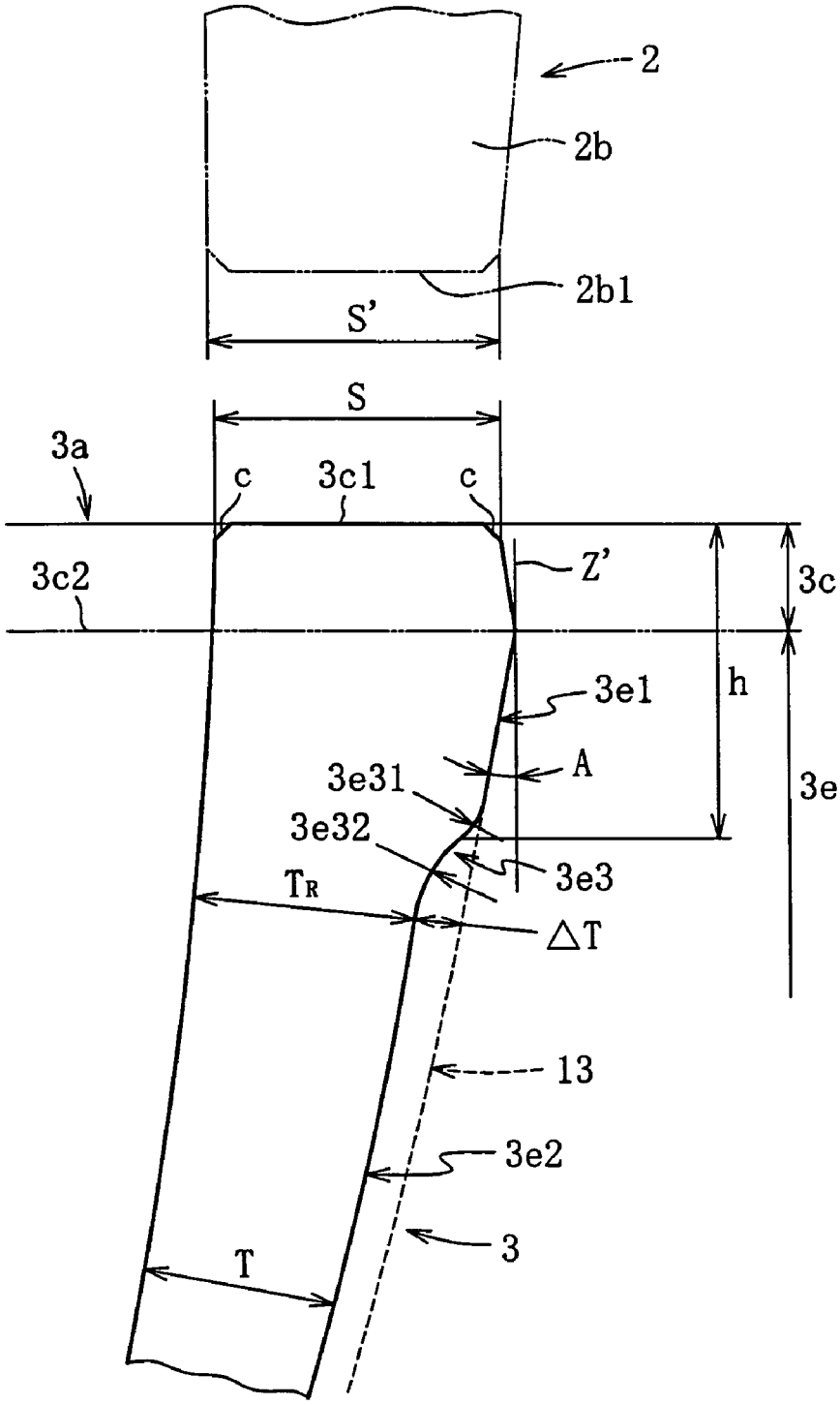
FIG. 5 is an enlarged partial sectional view showing the vicinity of a larger opening portion of the funnel.

FIG. 5 shows the vicinity of the larger opening portion 3*a* of the funnel 3.

The thickness S of the seal edge surface 3*c*1 is set to be almost equal to the thickness S' of the seal edge surface 2*b*1 of the panel 2. This secures a sufficient joint area between the two seal edge surfaces 2*b*1 and 3*c*1, thereby allowing easy and firm joint with the seal glass 5 for sealing. Here, the thickness S of the seal edge surface 3*c*1, if the edges of the larger opening portion 3*a* are given chamfers C (or roundings formed in molding), refers to the dimension including the dimensions of the chamfers C (or roundings) in the direction of thickness. The same holds true for the seal edge surface 2*b*1 of the panel 2.

The body portion 3*e* has a region 3*e*1 of dimension h measured from the seal edge surface 3*c*1 in the direction parallel to the tube axis Z, and the other region 3*e*2 excluding this region 3*e*1. The other region 3*e*2 has a thickness relatively smaller than the thickness of the region 3*e*1 of dimension h, so that the boundary portion between the two regions makes a stepped portion 3*e*3 on the external surface of the body portion 3*e* (for convenience of explanation, the region 3*e*1 of dimension h will hereinafter be referred to as "first region 3*e*1" and the other region 3*e*2 as "second region 3*e*2").

The dimension h of the first region 3*e*1 is set within the range of $0.5 \leqq h/S \leqq 1.5$ with respect to the thickness S of the seal edge surface 3*c*1. When the funnel 3 constitutes a cathode-ray tube accompanying with the panel 2, the first region 3*e*1 falls on a region to undergo tensile vacuum stress resulting from the vacuum pressure in the cathode-ray tube (see FIG. 7). In addition, the step ΔT of the stepped portion 3*e*3 is set within the range of $0.06 \leqq \Delta T/S \leqq 0.3$, and preferably $0.06 \leqq \Delta T/S \leqq 0.2$, with respect to the thickness S of the seal edge surface 3*c*1. Moreover, the thickness T at an arbitrary position of the second region 3*e*2 is set within the range of $0.5 \leqq T/T_R \leqq 1$ with respect to the thickness $T_R$ at the boundary with the stepped portion 3*e*3.

Additionally, in this embodiment, the stepped portion 3*e*3 is made of two curved surfaces 3*e*31 and 3*e*32. The radius of curvature R1 of the curved surface 3*e*31 on the side of the first region 3*e*1 and the radius of curvature R2 of the curved surface 3*e*32 on the side of the second region 3*e*2 are set to satisfy the relationships that $1 \leqq R2/R1 \leqq 3$ and $2 \leqq R1/\Delta T \leqq 20$. The stepped portion 3*e*3 is an area of point of change in thickness, and thus is prone to concentrating of vacuum stress. Forming this portion out of two curved surfaces 3*e*31 and 3*e*32 can effectively relieve the stress concentration. In particular, when the radii of curvature R1 and R2 of these curved surfaces 3*e*31 and 3*e*32 are set to satisfy the foregoing relationships, it is possible to avoid cracks of the funnel 3 resulting from defective molding or flaw occurrence while relieving the stress concentration.

Incidentally, the stepped portion 3*e*3 may be made of a combination of three or more curved surfaces. In this case, the radius of curvature R1 of a curved surface the closest to the first region 3*e*1 and the radius of curvature R2 of a curved surface the closest to the second region 3*e*2 are preferably set to satisfy the foregoing relationships. Moreover, the stepped portion 3*e*3 may be made of a single curved surface or straight surface. Otherwise, it may be made of an appropriate combination of one or more curved surfaces and straight surfaces.

Furthermore, in this embodiment, the external surface of the first region 3e1 forms an inclined surface spreading out toward the mold match line 3c2. An angle A formed between the foregoing external surface and a plane Z' parallel to the tube axis Z is set within the range of $3° \leqq A \leqq 15°$. This can enhance the releasability from the molds in press-molding the funnel 3, thereby preventing the external surface of the first region 3e1 from scratches with the molds and making the effect of the provision of the first region 3e1 practically effective.

Figure 6:
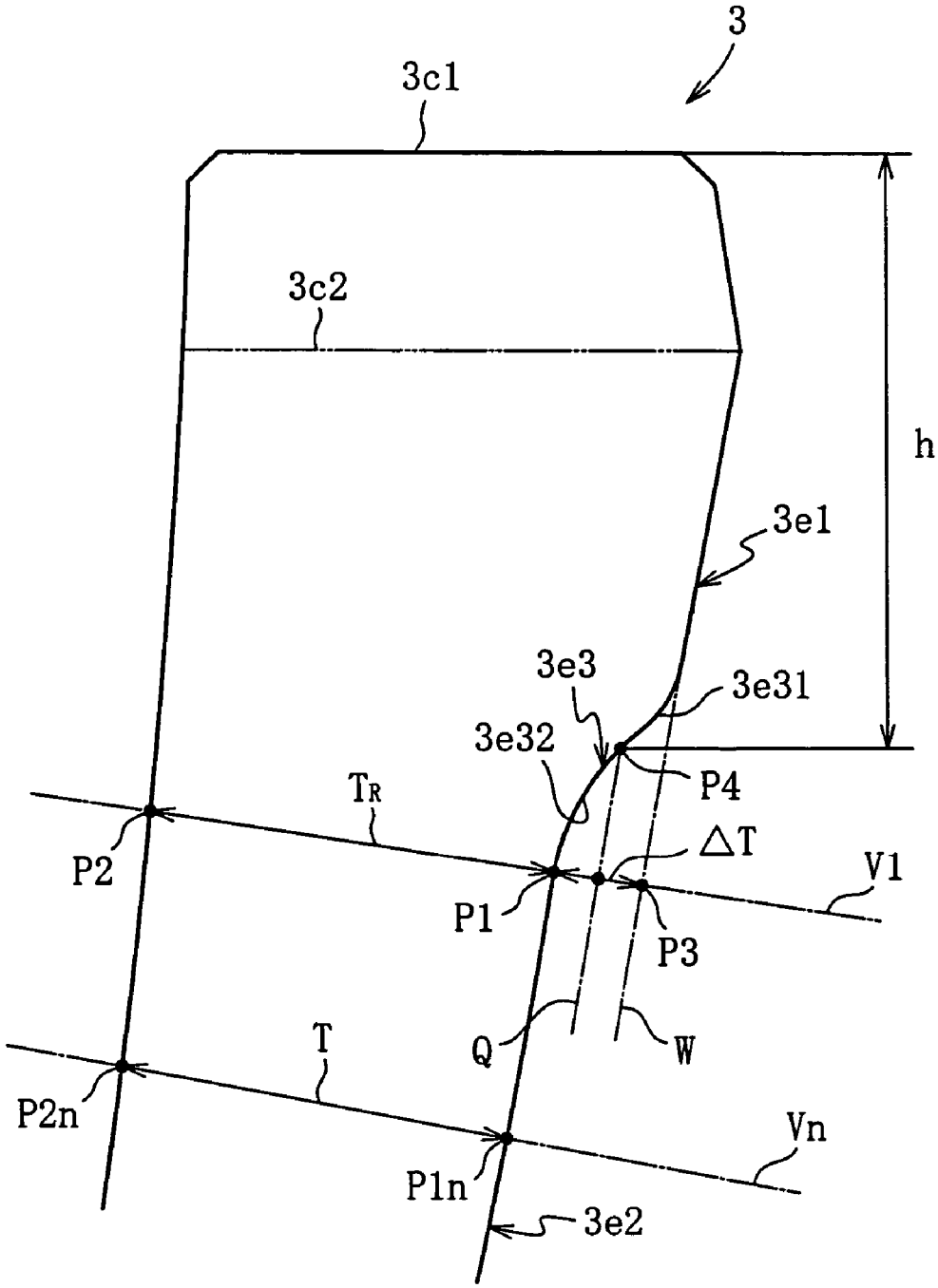
FIG. 6 is an enlarged partial sectional view showing the vicinity of the larger opening portion of the funnel.

The dimensions h, ΔT, $T_R$ and T mentioned above are determined according to references shown in FIG. 6 respectively. Initially, in a cross section parallel to the tube axis Z, a normal V1 to the external surface passing through a boundary point P1 between the stepped portion 3e3 and the second region 3e2 (in the example, shown in the same figure, a boundary between the curved surface 3e32 and the second region 3e2) is determined. When the intersecting point of the normal Vi with the internal surface is P2 and the intersecting point of the normal Vi with an extension line W of the external surface of the first region 3e1 is P3, $T_R$ is the length of the line segment P1–P2 and ΔT is the length of the line segment P1–P3. Next, a point P4 at which a line Q passing through the midpoint of the line segment P1–P3 (the position of ΔT/2) and is perpendicular to the normal V1 intersects the stepped portion 3e3 is determined. The length of a line segment that is drawn down from the position of the seal edge surface 3c1 to the position of the intersecting point P4 in a direction parallel to the tube axis z is h. T is the length of a line segment P1*n*–P2*n*, where P1*n* and P2*n* are the intersecting points of a normal Vn to the external surface at an arbitrary position of the second region 3e2 with the internal surface and the external surface.

Figure 7:
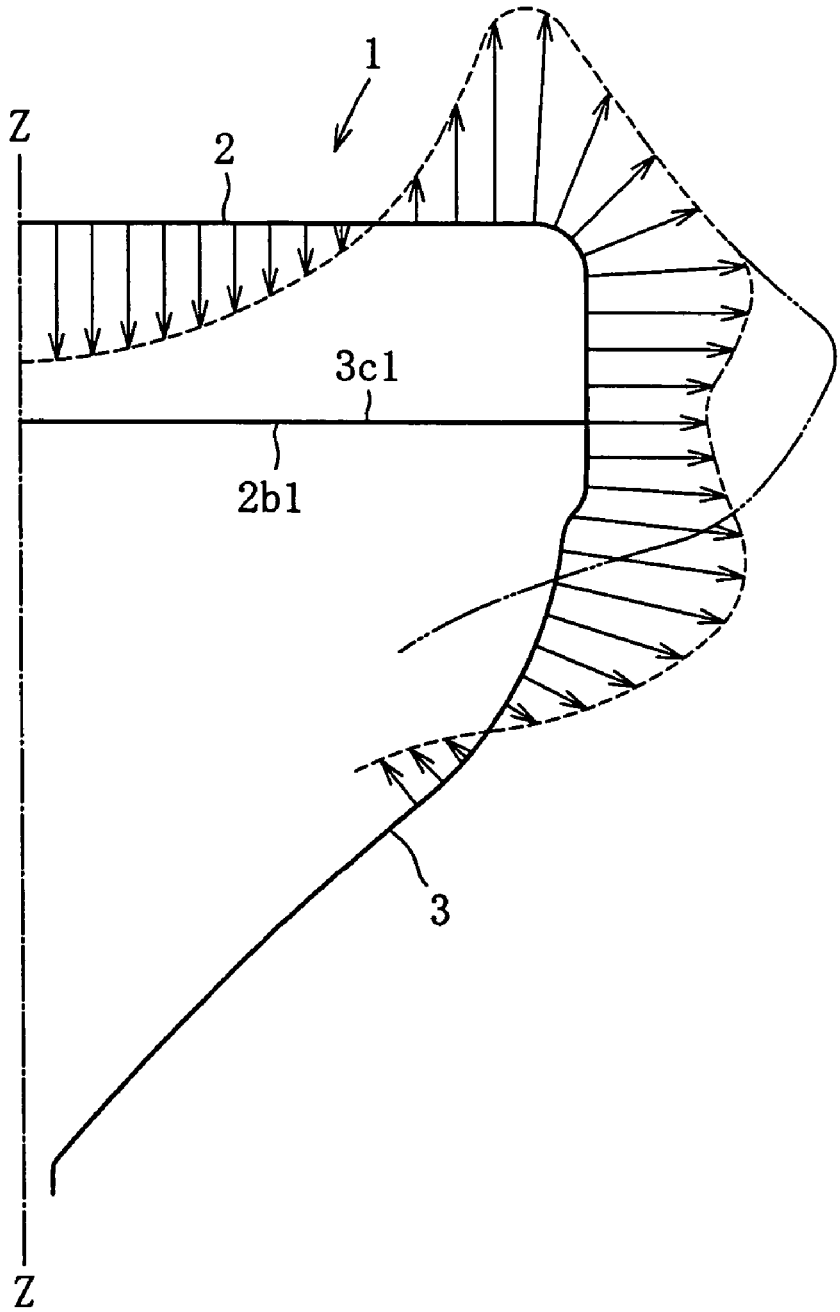
FIG. 7 is a diagram showing the distribution of vacuum stress acting on the glass bulb according to the embodiment.
Figure 11A:
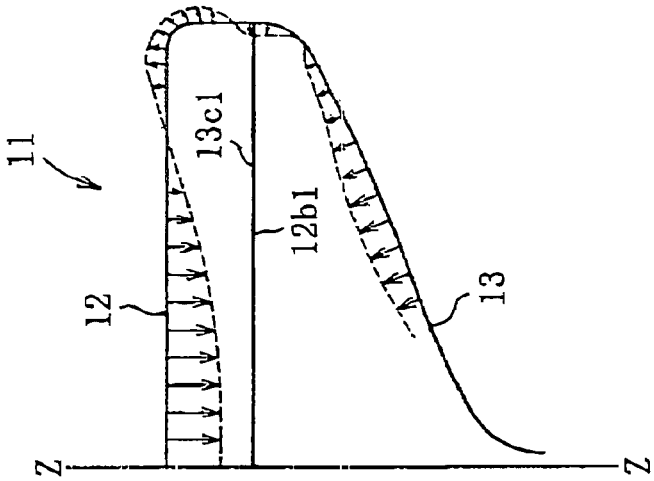
FIG. 11(a) (PRIOR ART)
FIG. 11(*a*)–FIG. 11(*c*) are diagrams showing the distribution of vacuum stress acting on the conventional glass bulb.
Figure 11B:
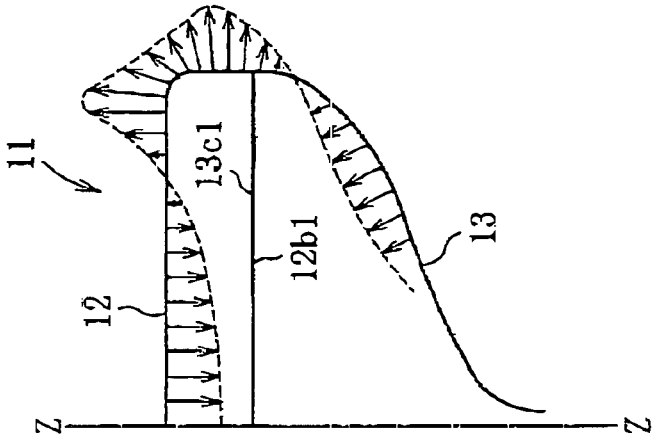
FIG. 11(b) (PRIOR ART)
Figure 11C:
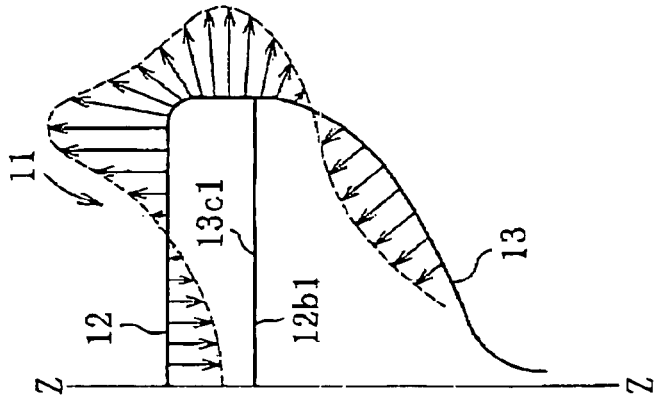
FIG. 11(c) (PRIOR ART)

The glass bulb 1 for a cathode-ray tube in this embodiment, constituted by joining the panel 2 and funnel 3 as aforesaid to each other, is used as a vacuum vessel after installing an electron gun in the neck portion 4 and then evacuating inside thereof (the internal pressure after the evacuation is on the order of, e.g., $10^{-8}$ Torr). FIG. 7 schematically shows the distribution of vacuum stress in the minor-axis section of the glass bulb 1 for a cathode-ray tube in this embodiment. In the diagram, the regions indicated with inward arrows represent regions undergoing compressive stress, and the region indicated with outward arrows regions undergoing tensile stress. Besides, the double-dashed chain line indicates the distribution of vacuum stress in a minor-axis section of the conventional glass bulb 11 for a cathode-ray tube {FIG. 11(*a*)}. As shown in the diagram, the tensile vacuum stress in the conventional glass bulb 11 for a cathode-ray tube peaks in the vicinity of the joint portion between the panel and the funnel (the double-dashed chain line). In the glass bulb 1 for a cathode-ray tube in this embodiment, the peak of the tensile vacuum stress shifts toward the side of the smaller opening portion 3*b* (toward the side of the neck tube 4) from the vicinity of the joint portion between the panel 2 and the funnel 3. The reason for this seems that the body portion 3*e* of the funnel 3 is provided with the first region 3e1 of relatively greater thickness on the side of the seal edge portion 3*c* and the second region 3e2 of relatively smaller thickness on the side of the smaller opening portion 3*b* (on the side of the neck tube 4). Thereby, the tensile vacuum stress in the vicinity of the joint portion may be dispersed due to elastic ductility of the second region 3e2 being thinned moderately, and thus increases in the degree of load on the second region 3e2. Incidentally, though omitted from the drawings, the distribution of vacuum stress in the major-axis section also shows generally the same tendency (the magnitude of the tensile vacuum stress is, however, smaller than in the minor-axis section).

Figure 9:
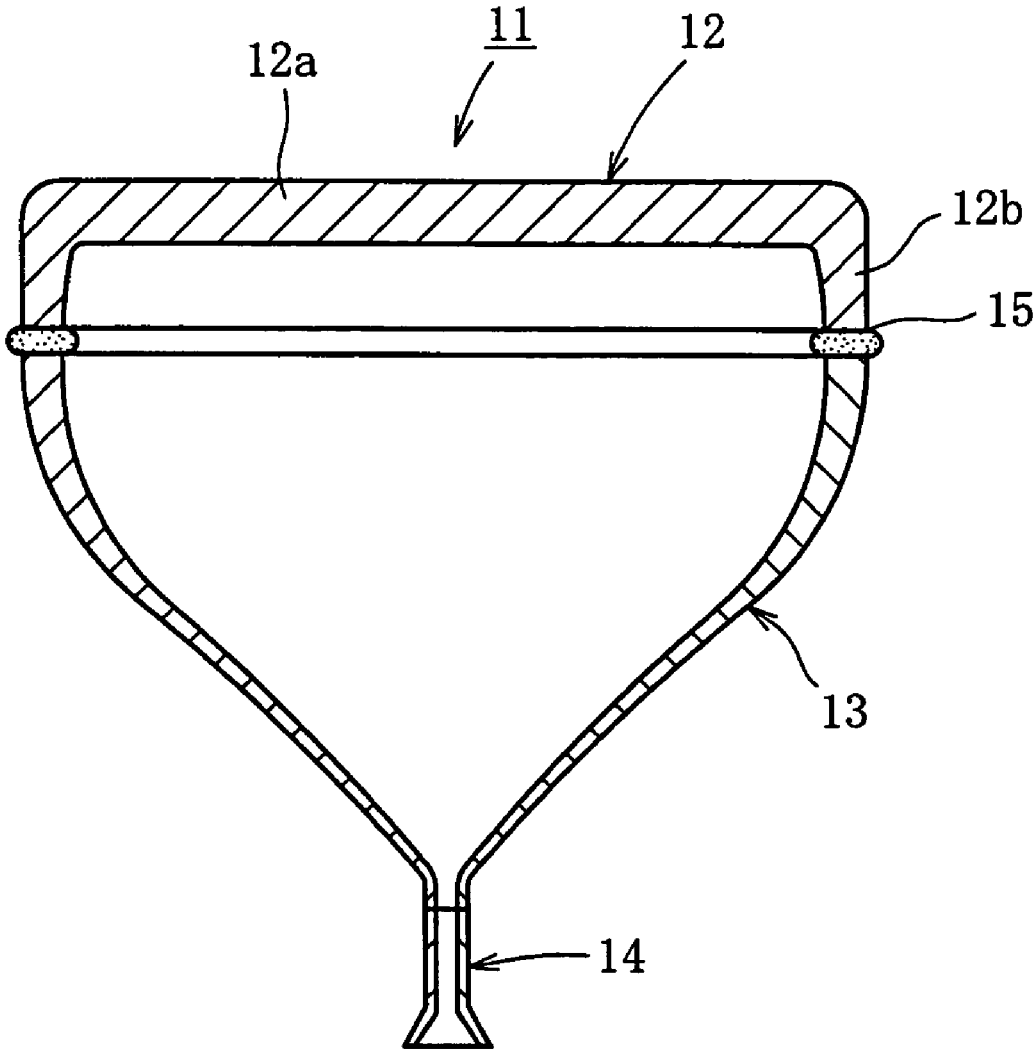
FIG. 9 (PRIOR ART)
FIG. 9 is a sectional view of a conventional glass bulb, taken along a direction parallel to the tube axis.
Figure 10:
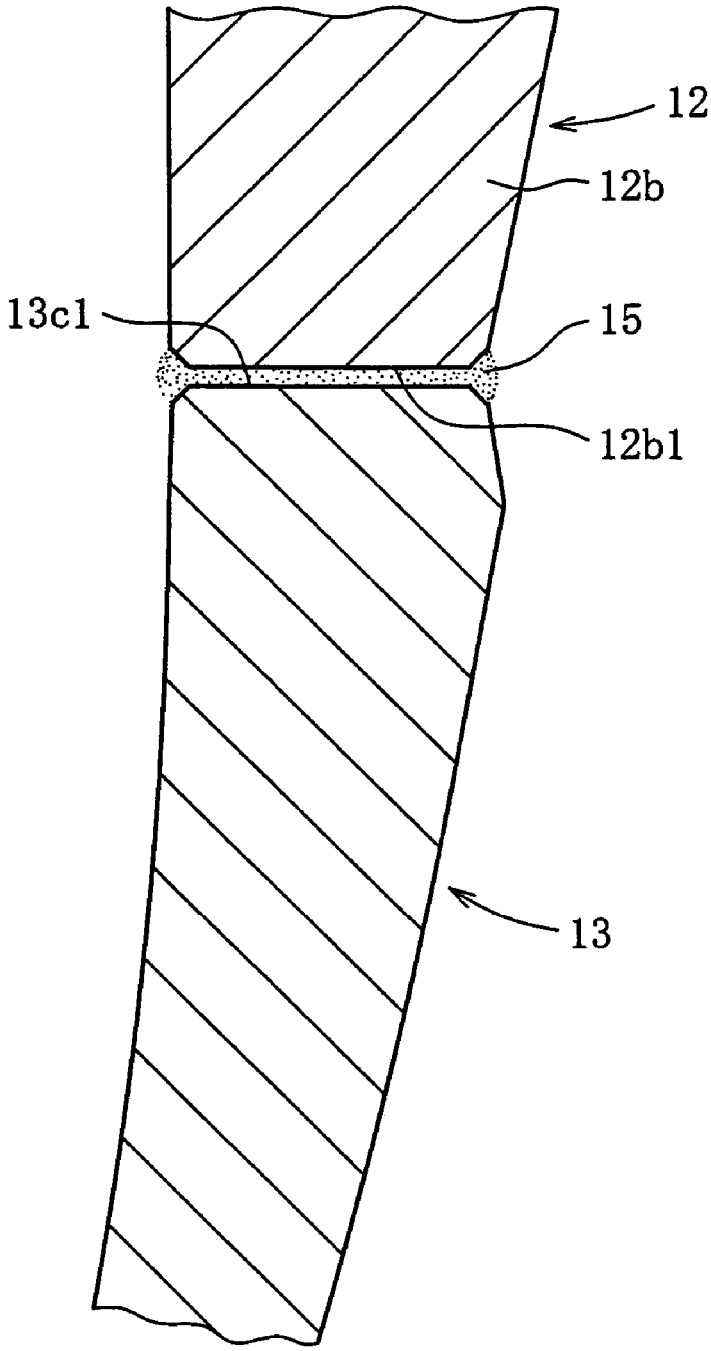
FIG. 10 (PRIOR ART)
FIG. 10 is an enlarged partial sectional view showing the vicinity of a joint portion between a panel and a funnel in the conventional glass bulb.

The configuration described above relieves the tensile vacuum stress acting on the joint portion as the weak point in strength. As a result, the glass bulb 1 for a cathode-ray tube further improves in the strength against vacuum fracture. In addition, the provision of the second region 3e2 having a relatively smaller thickness allows a weight reduction of the glass funnel 3 for a cathode-ray tube, furthermore the glass bulb 1 for a cathode-ray tube. Consequently, the glass funnel 3 for a cathode-ray tube of this embodiment, furthermore the glass bulb 1 for a cathode-ray tube of this embodiment, provides the contradictory characteristics of strength and light weight in favorable balance. Incidentally, in FIGS. 4 and 5, the external surface of the conventional funnel 13 in FIGS. 9 and 10 is shown by the dashed lines, schematically showing how the second region 3e2 of the funnel 3 of this embodiment is thinned.

Figure 8:
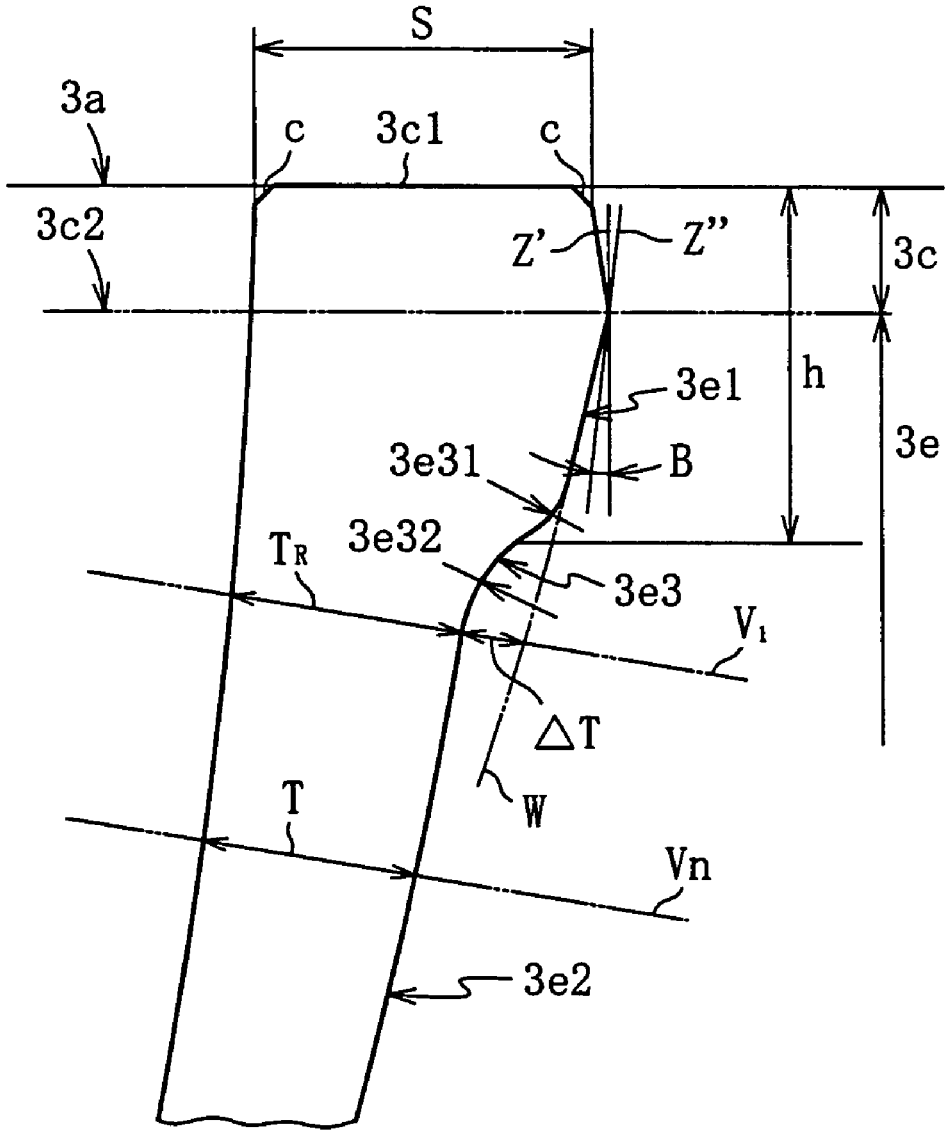
FIG. 8 is an enlarged partial sectional view showing the vicinity of the larger opening portion of a funnel according to another embodiment.

Another embodiment shown in FIG. 8 is one in which the external surface of the first region 3e1 of the funnel 3 forms a curved surface (arcuate surface) spreading out toward the mold match line 3c2. An angle B formed between a tangent plane Z" of the external surface across the mold match line 3c2 and a plane Z' parallel to the tube axis Z is set within the range of $3° \leqq B \leqq 15°$. This can enhance the releasability from the molds in press-forming the funnel 3, thereby preventing the external surface of the first region 3e1 from scratches with the molds and making the effect of the provision of the first region 3e1 practically effective.

Panels having the configuration shown in FIG. 2 (flat panels) and funnels having the configuration shown in FIGS. 3–6 (with the external surfaces of the first regions forming curved surfaces as shown in FIG. 8) were joined with seal glass for sealing to fabricate glass bulbs for a cathode-ray tube having the configuration shown in FIG. 1 (embodiments 1–11, comparative examples 1 and 2). Comparative tests were conducted with the conventional glass bulb for a cathode-ray tube (conventional example) shown in FIGS. 9 and 10. The comparative tests conducted were of two types. A comparative test 1 (embodiments 1–6, comparative examples 1 and 2) was made to check for the effect of (ΔT/S) settings, and a comparative test 2 (embodiments 7–11) to check for the effect of (h/S) settings. Each of the embodiments, comparative examples, and conventional example had a maximum outside diameter of 76 cm on the diagonal axis and a bulb deflection angle of 102°, with a panel of the following specifications. Table 1 shows the results of the comparative test 1, and Table 2 the results of the comparative test 2.

[Panel Specifications]

Panel center thickness: 13.5 mm

Radius of curvature of external surface (in minor-axis direction): 100000 mm

Radius of curvature of external surface (in major-axis direction): 100000 mm

Radius of curvature of external surface (in diagonal-axis direction): 100000 mm

Radius of curvature of internal surface (in minor-axis direction): 1480 mm

Radius of curvature of internal surface (in major-axis direction): 6240 mm

Radius of curvature of internal surface (in diagonal-axis direction): 5650 mm

TABLE 1

| | Comparative Test 1 (Unit of dimension: mm) | | | | | | | | |
|---|---|---|---|---|---|---|---|---|---|
| | Embodiment 1 | Embodiment 2 | Embodiment 3 | Embodiment 4 | Embodiment 5 | Embodiment 6 | Comparative example 1 | Comparative example 2 | Conventional example |
| h | 14.2 | 14.2 | 14.2 | 14.2 | 14.2 | 14.2 | 14.2 | 14.2 | — |
| S | 12.0 | 12.0 | 12.0 | 12.0 | 12.0 | 12.0 | 12.0 | 12.0 | 12.0 |
| ΔT | 0.7 | 1.2 | 1.7 | 2.3 | 2.9 | 3.5 | 0.5 | 4.1 | — |
| $T_R$ | 11.3 | 10.8 | 10.4 | 9.8 | 9.2 | 8.6 | 11.6 | 8.0 | — |
| T | 6.9 | 6.6 | 6.3 | 6.0 | 5.7 | 5.5 | 7.2 | 5.3 | 7.4 |
| R | 500 | 500 | 500 | 500 | 500 | 500 | 500 | 500 | — |
| B | 8.0 | 8.0 | 8.0 | 8.0 | 8.0 | 8.0 | 8.0 | 8.0 | — |
| R1 | 7.0 | 7.0 | 7.0 | 7.0 | 7.0 | 7.0 | 7.0 | 7.0 | — |
| R2 | 10.0 | 10.0 | 10.0 | 10.0 | 10.0 | 10.0 | 10.0 | 10.0 | — |
| ΔT/S | 0.06 | 0.10 | 0.14 | 0.19 | 0.24 | 0.29 | 0.04 | 0.34 | — |
| h/S | 1.2 | 1.2 | 1.2 | 1.2 | 1.2 | 1.2 | 1.2 | 1.2 | — |
| Tensile vacuum stress (at Joint portion) (MPa) | 8.21 | 8.01 | 7.66 | 6.97 | 6.21 | 5.45 | 8.32 | 4.55 | 8.39 |
| Tensile vacuum stress (at position of $T_R$) (MPa) | 6.35 | 6.63 | 6.97 | 7.38 | 7.80 | 8.21 | 6.21 | 8.63 | — |
| Funnel weight (kg) | 12 | 11.5 | 11.0 | 10.5 | 10.1 | 9.7 | 12.2 | 9.4 | 12.3 |

h: Dimension of first region in the direction parallel to tube axis
S: Thickness of seal edge surface, ΔT: Step, $T_R$: Thickness at boundary with stepped portion
T: Minimum thickness of body portion, R: Radius of curvature of external surface of first region
B: Angle formed between tangent plane Z" and plane Z'
R1, R2: Radius of curvature of stepped portion

TABLE 2

| | Comparative Test 2 (Unit of dimension: mm) | | | | | |
|---|---|---|---|---|---|---|
| | Embodiment 7 | Embodiment 8 | Embodiment 9 | Embodiment 10 | Embodiment 11 | Conventional example |
| h | 7.2 | 9.6 | 12.0 | 14.2 | 16.8 | — |
| S | 12.0 | 12.0 | 12.0 | 12.0 | 12.0 | 12.0 |
| ΔT | 1.7 | 1.7 | 1.7 | 1.7 | 1.7 | — |
| $T_R$ | 10.7 | 10.6 | 10.5 | 10.4 | 10.3 | — |
| T | 6.3 | 6.3 | 6.3 | 6.3 | 6.3 | 7.4 |
| R | 500 | 500 | 500 | 500 | 500 | — |
| B | 8.0 | 8.0 | 8.0 | 8.0 | 8.0 | — |
| R1 | 7.0 | 7.0 | 7.0 | 7.0 | 7.0 | — |
| R2 | 10.0 | 10.0 | 10.0 | 10.0 | 10.0 | — |
| ΔT/S | 0.14 | 0.14 | 0.14 | 0.14 | 0.14 | — |
| h/S | 0.6 | 0.8 | 1.0 | 1.2 | 1.4 | — |
| Tensile vacuum stress (at Joint portion) (MPa) | 8.21 | 8.01 | 7.82 | 7.66 | 7.45 | 8.39 |
| Tensile vacuum stress (at position of $T_R$) (MPa) | 6.14 | 6.35 | 6.63 | 6.97 | 7.38 | — |
| Funnel weight (kg) | 10.9 | 11.0 | 11.0 | 11.0 | 11.0 | 12.3 |

h: Dimension of first region in the direction parallel to tube axis
S: Thickness of seal edge surface, ΔT: Step, $T_R$: Thickness at boundary with stepped portion
T: Minimum thickness of body portion, R: Radius of curvature of external surface of first region
B: Angle formed between tangent plane Z" and plane Z'
R1, R2: Radius of curvature of stepped portion

EVALUATIONS ON COMPARATIVE TEST 1

Embodiment 1 to Embodiment 6

As compared to the conventional example, there were observed the effect of relieving the tensile vacuum stress at the joint portion and at the $T_R$ position and the effect of weight reduction. In addition, with an indication of a tensile vacuum stress value suppressed to or below 8.4 MPa as a reference of mechanical strength required of this type of glass bulb, the tensile vacuum stress values (5.45–8.21 MPa) were below the above reference value (8.4 MPa).

COMPARATIVE EXAMPLE 1

As compared to the conventional example, there was not observed a sufficient effect of relieving the tensile vacuum stress at the joint portion and a sufficient effect of weight reduction.

COMPARATIVE EXAMPLE 2

As compared to the conventional example, there were observed the effect of relieving the tensile vacuum stress at the joint portion and the effect of weight reduction, whereas the tensile vacuum stress at the $T_R$ position (8.63 MPa) exceeded the above reference value (8.4 MPa).

EVALUATIONS ON COMPARATIVE TEST 2

Embodiment 7 to Embodiment 11

As compared to the conventional example, there were observed the effect of relieving the tensile vacuum stress at the joint portion and at the $T_R$ position and the effect of weight reduction. Besides, with an indication of a tensile vacuum stress value suppressed to or below 8.4 MPa as a reference of mechanical strength required of this type of glass bulb, the tensile vacuum stress values (7.45–8.21 MPa) were below the above reference value (8.4 MPa).

As is evident from the results of the comparative tests, the funnels of the embodiments provide the contradictory characteristics of strength and light weight in favorable balance as compared to the comparative examples and the conventional example.

The invention claimed is:

1. A glass funnel for a cathode-ray tube, having a shape of a funnel with a larger opening portion at one end and a smaller opening portion at the other end, comprising a seal edge portion extending from a seal edge surface of said larger opening portion to a mold match line, a yoke portion to be equipped with a deflection yoke, said yoke portion being arranged at a side of said smaller opening portion, and a body portion continuing between said mold match line and said yoke portion, wherein:

said seal edge surface has a thickness almost equal to a thickness of a seal edge surface of a glass panel for a cathode-ray tube to be joined thereto;

said body portion has a region of dimension h measured from said seal edge surface in a direction parallel to a tube axis and the other region excluding said region of dimension h;

when constituting a cathode-ray tube, said region of dimension h falls on a region to undergo tensile vacuum stress resulting from a vacuum pressure in said cathode-ray tube;

said other region has a thickness smaller than a thickness of said region of dimension h, so that a boundary portion between said region of dimension h and said other region forms a stepped portion on an external surface of said body portion;

said stepped portion has a step $\Delta T$ of $0.06 \leqq \Delta T/S \leqq 0.3$ with respect to a thickness S of said seal edge surface.

2. The glass funnel for a cathode-ray tube according to claim 1, wherein said dimension h falls within $0.5 \leqq h/S \leqq 1.5$ with respect to the thickness S of said seal edge surface.

3. The glass funnel for a cathode-ray tube according to claim 1, wherein said other region has a thickness T of $0.5 \leqq T/T_R \leqq 1$ with respect to a thickness $T_R$ at a boundary with said stepped portion.

4. The glass funnel for a cathode-ray tube according to claim 1, wherein an external surface of said region of dimension h forms an inclined surface spreading out toward said mold match line, and said external surface and a plane parallel to said tube axis forms an angle A of $3° \leqq A \leqq 15°$.

5. The glass funnel for a cathode-ray tube according to claim 1, wherein an external surface of said region of dimension h forms a curved surface spreading out toward said mold match line, and a tangent plane of said external surface across said mold match line and a plane parallel to said tube axis forms an angle B of $3° \leqq B \leqq 15°$.

6. The glass funnel for a cathode-ray tube according to claim 1, wherein the seal edge surface of the larger opening portion is aligned and connected to the seal edge surface of the glass panel.

7. A glass bulb for a cathode-ray tube comprising:

a glass panel for a cathode-ray tube including a face portion having a substantially flat external surface, a skirt portion extending from the periphery of said face portion, and a seal edge surface arranged on an end surface of said skirt portion;

a glass funnel, having a shape of a funnel with a larger opening portion at one end and a smaller opening portion at the other end, comprising a seal edge portion extending from a seal edge surface of said larger opening portion to a mold match line, a yoke portion to be equipped with a deflection yoke, said yoke portion being arranged at a side of said smaller opening portion, and a body portion continuing between said mold match line and said yoke portion, wherein:

said seal edge surface has a thickness almost equal to a thickness of a seal edge surface of a glass panel for a cathode-ray tube to be joined thereto;

said body portion has a region of dimension h measured from said seal edge surface in a direction parallel to a tube axis and the other region excluding said region of dimension h;

when constituting a cathode-ray tube, said region of dimension h falls on a region to undergo tensile vacuum stress resulting from a vacuum pressure in said cathode-ray tube;

said other region has a thickness smaller than a thickness of said region of dimension h, so that a boundary portion between said region of dimension h and said other region forms a stepped portion on an external surface of said body portion;

said stepped portion has a step $\Delta T$ of $0.06 \leqq \Delta T/S \leqq 0.3$ with respect to a thickness S of said seal edge surface; and a neck portion to be equipped with an electron gun, said neck portion being joined to said smaller opening portion of the glass funnel for a cathode-ray tube, wherein said seal edge surface of said glass panel for a cathode-ray tube and said seal edge surface of the glass funnel for a cathode-ray tube are joined to each other.

8. The glass bulb for a cathode-ray tube according to claim 7, wherein said dimension h falls of the glass funnel within $0.5 \leqq h/S \leqq 1.5$ with respect to the thickness S of said seal edge surface.

9. The glass bulb for a cathode-ray tube according to claim 7, wherein said other region of the glass funnel has a thickness T of $0.5 \leqq T/T_R \leqq 1$ with respect to a thickness $T_R$ at a boundary with said stepped portion.

10. The glass bulb for a cathode-ray tube according to claim 7, wherein an external surface of said region of dimension h of the glass funnel forms an inclined surface spreading out toward said mold match line, and said external surface and a plane parallel to said tube axis forms an angle A of $3° \leqq A \leqq 15°$.

11. The glass bulb for a cathode-ray tube according to claim 7, wherein an external surface of said region of dimension h of the glass funnel forms a curved surface spreading out toward said mold match line, and a tangent plane of said external surface across said mold match line and a plane parallel to said tube axis forms an angle B of $3° \leqq B \leqq 15°$.

12. The glass bulb for a cathode-ray tube according to claim 7, wherein the seal edge surface of the larger opening portion is aligned and connected to the seal edge surface of the glass panel.

* * * * *